US008925365B2

(12) United States Patent
Schöllhammer

(10) Patent No.: US 8,925,365 B2
(45) Date of Patent: Jan. 6, 2015

(54) PRESS WITH VARIABLE RIGIDITY

(75) Inventor: Dietmar Schöllhammer, Göppingen (DE)

(73) Assignee: Schuler Pressen GmbH & Co. KG, Göppingen (DE)

( * ) Notice: Subject to any disclaimer, the term of this patent is extended or adjusted under 35 U.S.C. 154(b) by 1466 days.

(21) Appl. No.: 12/075,256

(22) Filed: Mar. 10, 2008

(65) Prior Publication Data

US 2008/0223230 A1 Sep. 18, 2008

(30) Foreign Application Priority Data

Mar. 17, 2009 (DE) ..... 10 2007 012 860

(51) Int. Cl.

| | |
|---|---|
| ***B21D 37/00*** | (2006.01) |
| ***B21D 37/10*** | (2006.01) |
| ***B30B 15/06*** | (2006.01) |
| ***B21D 22/00*** | (2006.01) |

(52) U.S. Cl.

CPC ..... *B30B 15/062* (2013.01); *B21D 37/10* (2013.01); *B21D 22/00* (2013.01); *B30B 15/06* (2013.01)

USPC ..... 72/455; 72/465.1; 72/477; 72/481.1

(58) Field of Classification Search

USPC ..... 72/455, 465.1, 477, 478, 481.1; 100/211, 295

See application file for complete search history.

(56) References Cited

U.S. PATENT DOCUMENTS

| | | | | |
|---|---|---|---|---|
| 3,926,032 | A * | 12/1975 | Brooks et al. | 72/419 |
| 4,207,048 | A * | 6/1980 | Seymour | 425/151 |
| 5,094,796 | A | 3/1992 | Katoh et al. | |
| 5,715,721 | A * | 2/1998 | Anders et al. | 72/311 |
| 2004/0159140 | A1 * | 8/2004 | Daniel et al. | 72/455 |

FOREIGN PATENT DOCUMENTS

| | | |
|---|---|---|
| DE | 101 48 954 A1 | 4/2003 |
| EP | 0 544 137 A2 | 6/1993 |

* cited by examiner

*Primary Examiner* — Teresa M Ekiert

(74) *Attorney, Agent, or Firm* — R. S. Lombard; K. Bach

(57) ABSTRACT

In a press comprising at least one tool part with certain rigidity, the rigidity of the tool part is adjustable by changing the coupling of the tool part to the plunger or the press table to control the transmission of deformations by bending.

9 Claims, 8 Drawing Sheets

PRESS WITH VARIABLE RIGIDITY

CROSS-REFERENCE TO RELATED APPLICATION

This application claims the priority benefits of German Application No. 10 2007 012 860.8 filed Mar. 17, 2007.

BACKGROUND OF THE INVENTION

The invention resides in a press tool for installation in different presses.

It is known that press tools in particular in connection with large-part presses are subjected to bending under the effect of the press pressure. The bending is load-dependent. The tool is designed to bend by a certain pre-calculated amount.

The bending tool parts are supported by the press table or, respectively, the press plunger. With the bending of the tool parts also the press table and/or press plunger is subjected to a certain amount of bending. The finally occurring bending therefore does not depend only on the load effective on the tool (press force), but also on the rigidity properties of the plunger and/or the press table.

It has already been tried to prevent the bending of the tool by totally compensating for it. To this end, DE 44 15 577 A1 proposes a support plate which includes several hydraulic actuators. The actuators are controlled by means of a hydraulic system which again is controlled by a distance or bending sensor, for controlling the pressure applied to the compensation pistons. The publication assumes that the press table and the press plunger are subjected to bending which is fully compensated for by the hydraulic activators so that neither the upper nor the lower tool part experience any bending when they are subjected to load.

The actively controlled tool support plate requires, however, an additional installation space which reduces from the free height present between the plunger and the tool table. In addition, the use of the compensation plate requires tools which are designed to basically not bend during use. Such tools, however, are not usable without a corresponding compensation plate because of the then unavoidable bending. They must, therefore, be designed specifically for use in connection with a corresponding compensation plate.

Based on this state of the art, it is the object of the present invention to provide a possibility for controlling the bending of the tool in a simple manner.

SUMMARY OF THE INVENTION

In a press comprising at least one tool part with certain rigidity, the rigidity of the tool part is adjustable by changing the coupling of the tool part to the plunger or the press table to control the transmission of deformations by bending.

With the press according to the invention, the bending of the tool during press-operation can be controlled in a particular way. This is achieved by adapting the press table and/or the tool, that is at least one tool part thereof, to the rigidity of the supporting press part (that is the plunger or, respectively, the table of the press onto which the tool is to be placed). The tool part and/or the press part has an adjustable rigidity so that, with the installation in different presses with different plungers and/or tool tables with different rigidities, the desired overall rigidity in connection with the respective plunger and/or the respective press table is obtained. During the setting up of the press consequently, the rigidity of the tool part and/or the press part is adjusted to the desired value. If, for example, the tool is installed in a press with a less rigid plunger and/or press table, the rigidity of the tool part is adjusted to a higher value. If, on the other hand, the tool is installed in a press with high rigidity of the plunger and/or the press table, the rigidity of the respective press part is adjusted to a lower value, for example, by the removal of a coupling element. In both cases the over-all rigidity, which is obtained with the rigidity of the tool part and the respective press part (plunger and/or press table), is essentially the same.

The tool is provided with appropriate means for adjusting the rigidity of the tool part and/or the press part. These means can be of multifaceted nature. In the most simple case, they are, for example, mechanical force-transmitting elements which are supported on or in the tool part or between the tool part and the plunger or, respectively, the press table. These force transmitting elements may be bolts, plates, webs, rods or similar devices insertable, for example, into recesses in the tool part and/or the press part. The force-transmitting elements may also be intermediate plates or webs or other elements which can be arranged between the tool part and the press table or, respectively, the plunger. The overall rigidity effective on the tool is changed, for example, by a change of the force-transmitting or the coupling conditions between the press part and the tool part. Corresponding means can be formed by the above-mentioned intermediate plates, webs or other elements.

The rigidity of the overall arrangement comprising the tool part and the plunger or, respectively, the press table can be changed at least between two different values by the insertion of the respective additional component into its predetermined installation position or its removal from the tool part. The additional component forms a stiffening element. Its own rigidity is not so much important, more important is the influence it has on the coupling between the tool part and the press part.

It is furthermore possible, to keep various additional parts in store, so as to make means available which, by selection of the respective suitable additional component facilitate the establishment of the desired coupling between the tool part and the press part and, consequently, the contribution of the rigidity of the press part, which is transmitted to the tool part. In this way, the rigidity of the tool part can finally be adjusted.

With the measures described above, it is possible to obtain a desired bending of the tool or, respectively, the tool parts independently of the rigidity of the press and particularly its plunger and its press table at a given load. Preferably, herein a bending is adjusted according to the design parameters for the manufacture and operation of the tool. As a result, the present invention provides for measures which permit an improvement of the quality of the manufactured product of the press or the tool using very simple means.

The invention will become more readily apparent from the description of advantageous embodiments on the basis of the accompanying drawings.

DESCRIPTION OF THE VARIOUS EMBODIMENTS

Figure 1:
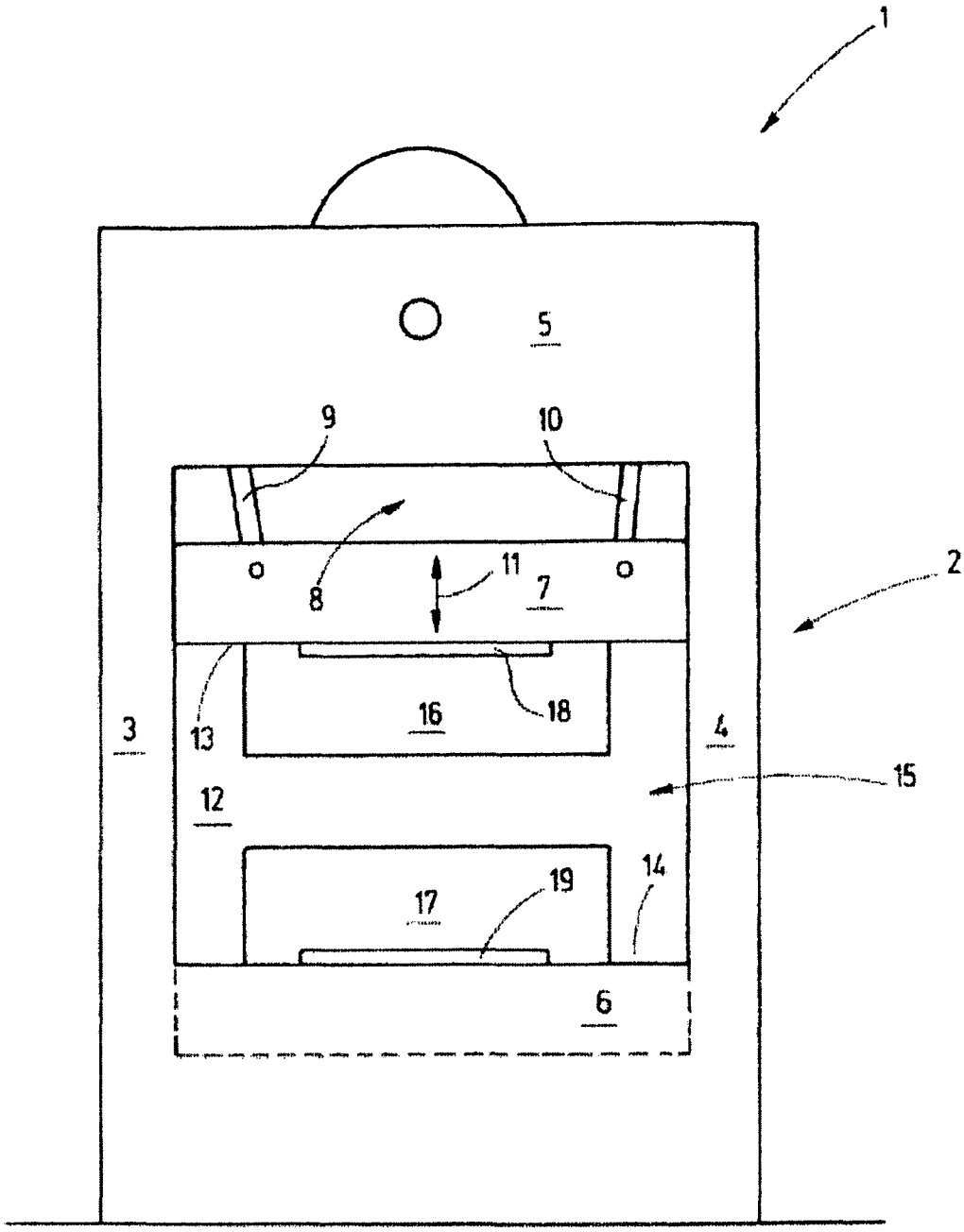
FIG. 1 is a schematic representation of the press with a tool.

FIG. 1 shows a press 1 which comprises a press frame 2 including a press stand 3, 4, a head piece 5 supported by the press stands 3, 4 and a press table 6. The press table 6 may, for example, be in the form of a slide table which is slidably removable from the press frame 2 in a predetermined direction.

Above the press table 6, there is a plunger 7 which supported so as to be movable toward the press table 6 and away therefrom in the embodiment shown in a vertical direction. The plunger is provided with a press drive 8 which is disposed in or at the head piece 5. The drive 8 moves the plunger 7, for example, via a connecting rod 9, 10. The plunger 7 executes a movement which is indicated in FIG. 1 by an arrow 11.

Between the plunger 7 and the press table 6, there is a tool accommodation space 12 which is delimited on one side by a surface 13 of the plunger 7 and at the other side by the surface 14 of the press table 6.

In the tool accommodation space 12, a tool 15 is arranged which includes an upper tool part 16 and a lower tool part 17. The tool 15 serves for the transformation of a workpiece, for example, a vehicle body part (such as a fender, a body side part, a roof, a motor hood, a vehicle body floor, etc.). The tool 15 provides with each stroke of the press for the desired transformation of the metal sheet which has been placed into the tool 15 by a transfer arrangement which is not shown.

Figure 2:
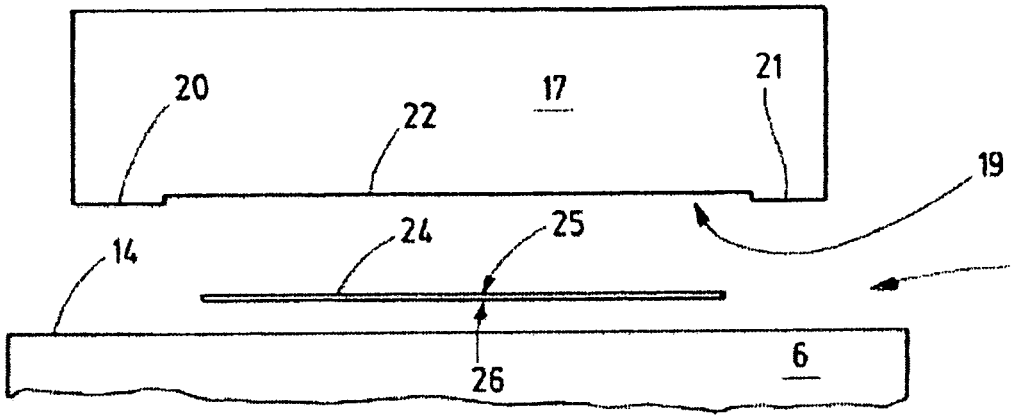
FIG. 2 shows the press table and the lower tool part shown in FIG. 1 and additional parts schematically in an exploded view.

The upper tool part 16 is held on the surface 13 of the plunger 7. The lower tool part 17 is supported on the surface 14 of the press table 6. At least one of the tool parts 16, 17, in the embodiment shown herein, both include means for changing the rigidity of the respective tool part 16 and respectively 17 to counteract bending under load. These means comprise in both cases a recess 18, 19 which are provided on the sides of the tool parts 16, 17 adjacent the respective support surfaces 13, 14. FIG. 2 shows this in a more detailed way with respect to the lower tool part 17 and the press table 6. The following description applies correspondingly also to the upper tool part 16 and the plunger 7.

The recess 19 is disposed adjacent the surface 14 and is open toward that surface. At least two opposite sides of the recess 19 of the tool part 17 is provided with support surfaces 20, 21. With these support surfaces, the tool part 17 directly abuts the surface 14. The recess 19 is delimited herein on one hand by the surface 14 and, on the other hand, by the recess bottom wall 22. The recess bottom wall 22 may be a planar surface. In the same way, also this surface 14 may be a planar surface. The recess bottom wall 22 as well as the surface 14 may be provided with structures, cavities, opening, grooves, projections, etc. as needed.

In the assembled state, a slot or gap is formed between the recess bottom wall 22 and the surface 14. Into this slot an additional component 23 can be inserted when needed. This additional component is shown in the embodiment of FIG. 2 in the form of a flat plate 24. The thickness of this plate 24 corresponds preferably to the depth of the recess 19 that is the distance between this surface 14 and the recess bottom wall 22. The dimensions may herein be so selected that the plate 24 is firmly engaged or clamped in the recess 19 when the tool part 17 is mounted on the press table 6. With regard to the length and the width of the plate 24 the dimensions may differ from those of the recess 19 as shown. But the plate 24, may also be so sized that it completely fills the recess 19. In the embodiment shown, the plate 24 is a continuous plate with flat parallel side walls 25, 26.

Particularly with regard to its variable rigidity the tool 15 operates as follows:

During operation of the press, the tool parts 16, 17 are subjected to high loads particularly in the direction of the arrow 11. As a result, the lower tool part 17 has a tendency to bend downwardly, while the upper tool part 16 has a tendency to bend upwardly. If the additional part 23 is not present, the bending of these tool parts 16, 17 is transmitted to the plunger 7 and, respectively the press table 6 only to a small extent. The bending is then determined mainly by the rigidity of the tool parts 16 and, respectively 17. This setting of the press 1 is particularly expedient if the plunger 7 and the press table 6 have a very high intrinsic rigidity. The tool parts 16, 17 will be bent to a predetermined value.

If the same tool is now installed in another press 1 whose plunger 7 and press table 6 have a lower intrinsic rigidity, the additional component 23 is inserted into the recess 19. This results with respect to the bending of the tool parts 16, 17 in a coupling with the plunger 7 and the press table 6. As a result, an overall rigidity is obtained which is influenced to a larger degree by the intrinsic rigidity of the plunger 7 and the press table 6. In other words, the tool parts 16, 17 are now more firmly coupled to the plunger 7 and the press table 6 and, although the rigidity of the plunger 7 and the press table 6 is lower, they now contribute to the stiffening of the tool parts 16, 17 to provide for the same rigidity as provided by the more rigid press parts (plunger 7 and press table 6) mentioned in the first example.

Figure 3:
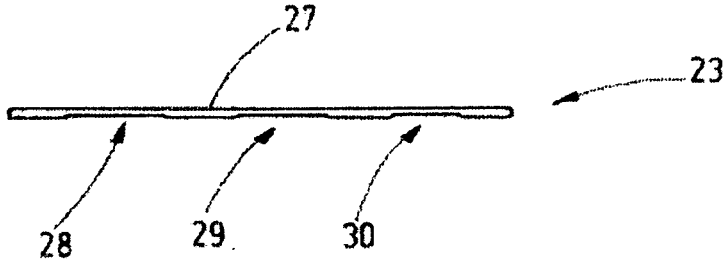
FIG. 3 shows a modified embodiment of the additional part of FIG. 2 in a schematic side view.

For the adaptation to different other presses, it may be expedient to provide exchangeable additional components 23 which permit a different coupling between the tool part 16 and/or 17 and the respective press part 6 and/or 7. FIG. 3 shows, for example, a plate 27 which is provided at a flat side thereof with recesses 28, 29, 30. Those recesses change the coupling between the respective tool part 16 or 17 and the respective press part 6 or 7 and therefore facilitate the adaptation of the overall rigidity to a different value.

Figure 4:
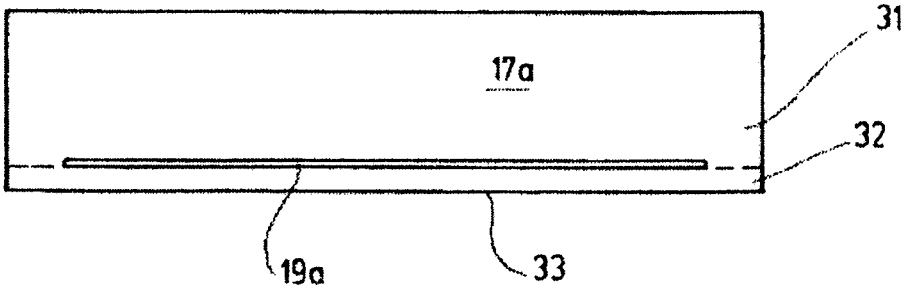
FIG. 4 shows a modified embodiment of the lower tool part which includes a recess for accommodating a stiffening part.

A modified embodiment of the tool part 17 is shown in FIG. 4 as a tool part 17*a*. The tool part 17*a* comprises a slot-like recess 19*a* which is formed between two parts 31, 32 of the tool part 17*a*. Preferably the slot-like recess 19*a* is oriented parallel to the support surfaces 33 of the tool part 17*a*. It also is adapted to accommodate an additional component 23, for example, in the form of a plate 24.

Figure 5:
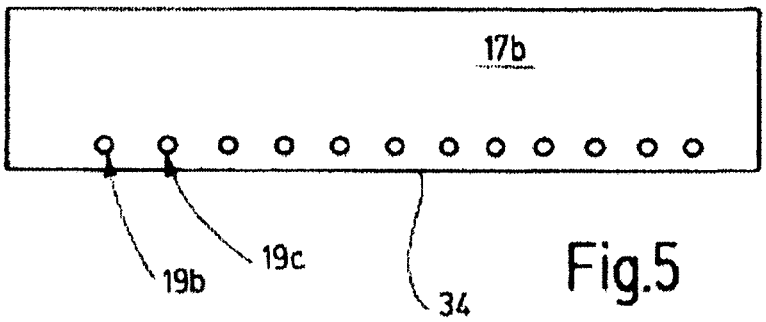
FIG. 5 shows in a schematic representation a modified embodiment of the lower tool part with several recesses for accommodating several stiffening parts.

A further modified embodiment of the tool part 17 is shown in FIG. 5 as a tool part 17*b*. Instead of the recess 19, a number of openings 19*b*, 19*c*, etc. are provided which are arranged, for example, in proximity to the support surface 34. The openings 19*b*, 19*c*, etc. may be bores, for example, through bores or dead end bores. They reduce the rigidity of the tool part 17*b*. Associated with the bores 19*b*, 19*c* may, for example, be bolts, not shown, which may be inserted into the bores 19*b*, 19*c* to fill them and thereby increase the rigidity of the tool part 17*b*. In this way, a further means for adjusting or respectively changing the bending rigidity of the tool part 17*b* is provided.

Figure 6:
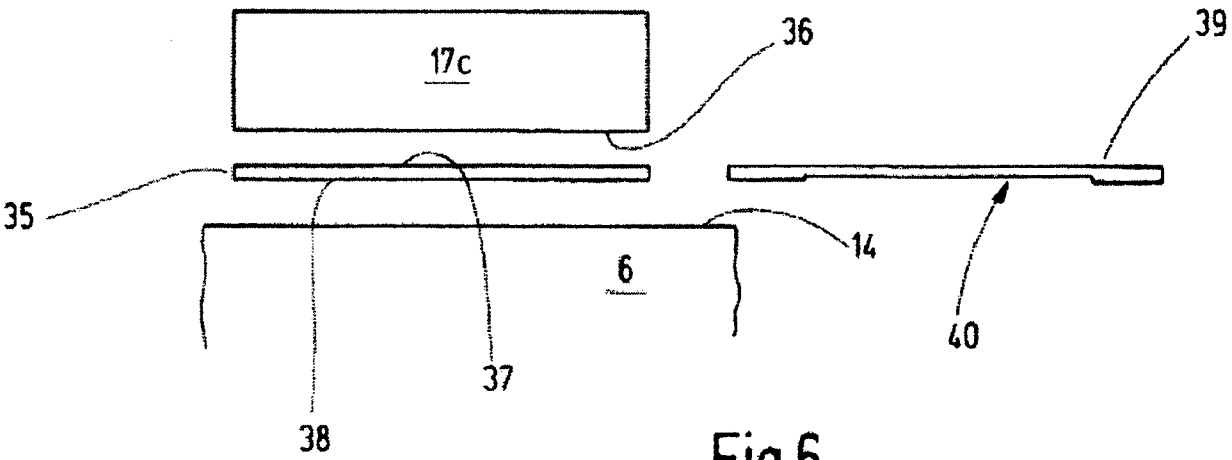
FIG. 6 shows in a schematic sectional view of an embodiment of the invention with a stiffening part in the form of an intermediate plate.

FIG. 6 shows another modified embodiment of the means for stiffening the tool part. In this case, the tool part is represented as tool part 17*c* which is placed onto the support surface 14 with an intermediate plate 35 disposed therebetween. The intermediate plate 35 is clamped between the support surface 14 and the engagement surface 36. With the shape selected for the intermediate plate 35, the rigidity of the tool 17 can be adjusted. In the first case, the intermediate plate is a flat continuous plate with parallel opposite side surfaces 37, 38. This intermediate plate 35 is used for the mounting of a tool part 17*c* on a press table 6 with relatively low rigidity. If the tool 17*c* is to be mounted on a press table 6 with higher rigidity an intermediate plate 39 is provided which includes one or more recesses 40. The recess 40 may be provided, for example, in the upper or the lower flat surface 37 or 38. It provides for only a partial transmission of the bending of the tool part 17*c* to the press table 6. The intermediate plate 39 is provided for the mounting of the tool part 17*c* on motorized press tables 6.

Different intermediate plates 39 with differently sized recesses 40 may be provided so as to represent a continuation set which permits the adaptation of the tool part 17*c* to presses with very differently rigid press tables 6. The same concept applies to the tool parts 16 and the plunger 7 and respective intermediate plates.

Figure 7:
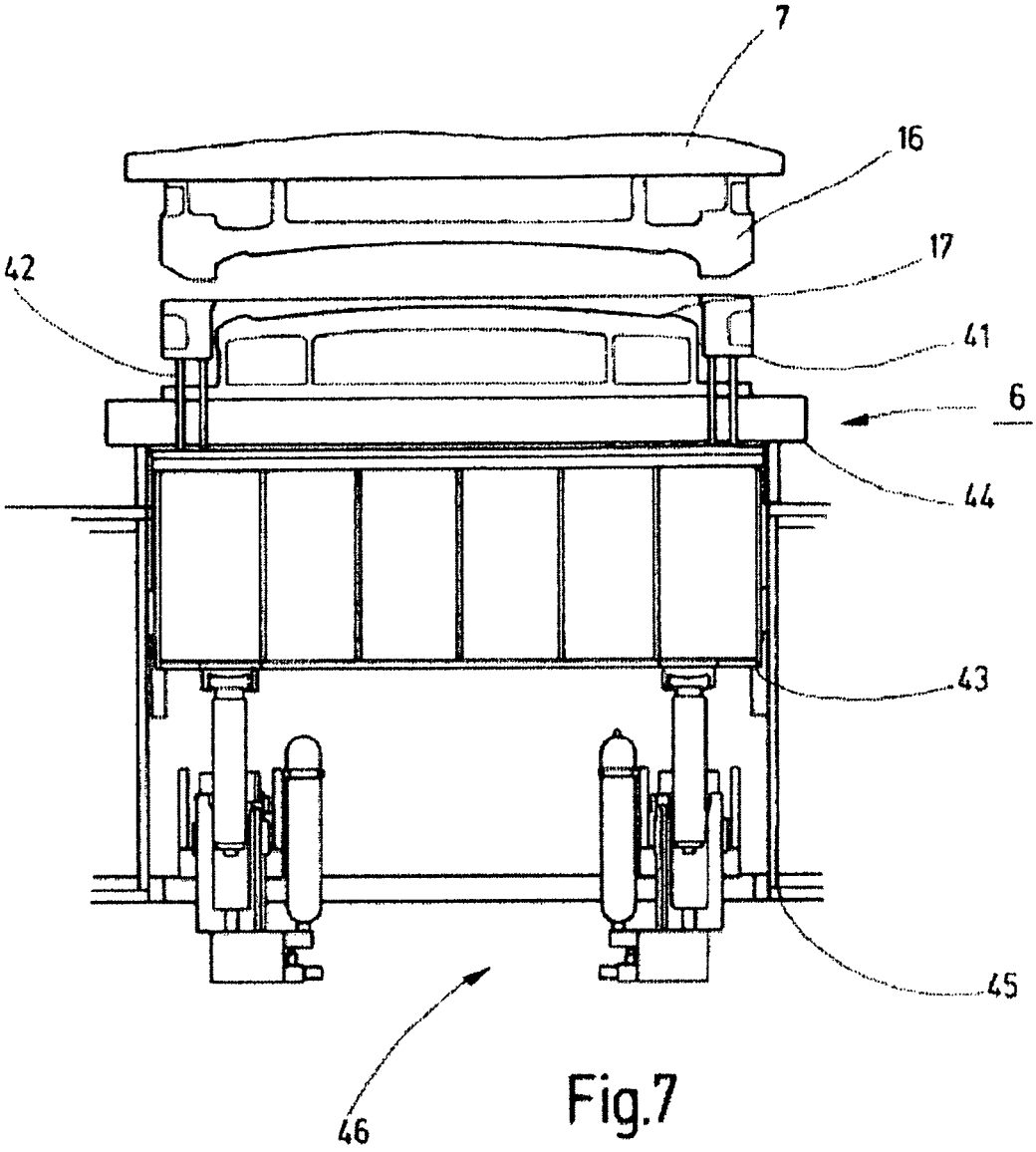
FIG. 7 shows a typical embodiment of a drawing press including a press table and a plunger in a sectional view.

FIG. 7 shows a press table 6 in the form of a movable or slidable table 44 and the tool part 17 for a drawing press. The tool part 17 includes in this embodiment a metal sheet support ring 41 which is supported on a drawing pillow 43 by pressure piece 42. The whole arrangement is supported by the movable or slidable press table 44. The slidable table 44 is supported on a press base 45. Below the drawing pillow 43, there is a force generation arrangement 46 including, for example, several hydraulic cylinders for generating a force directed upwardly to the drawing pillow 43. Conventionally the slide table 44 has a relatively low bending stiffness.

Figure 8:
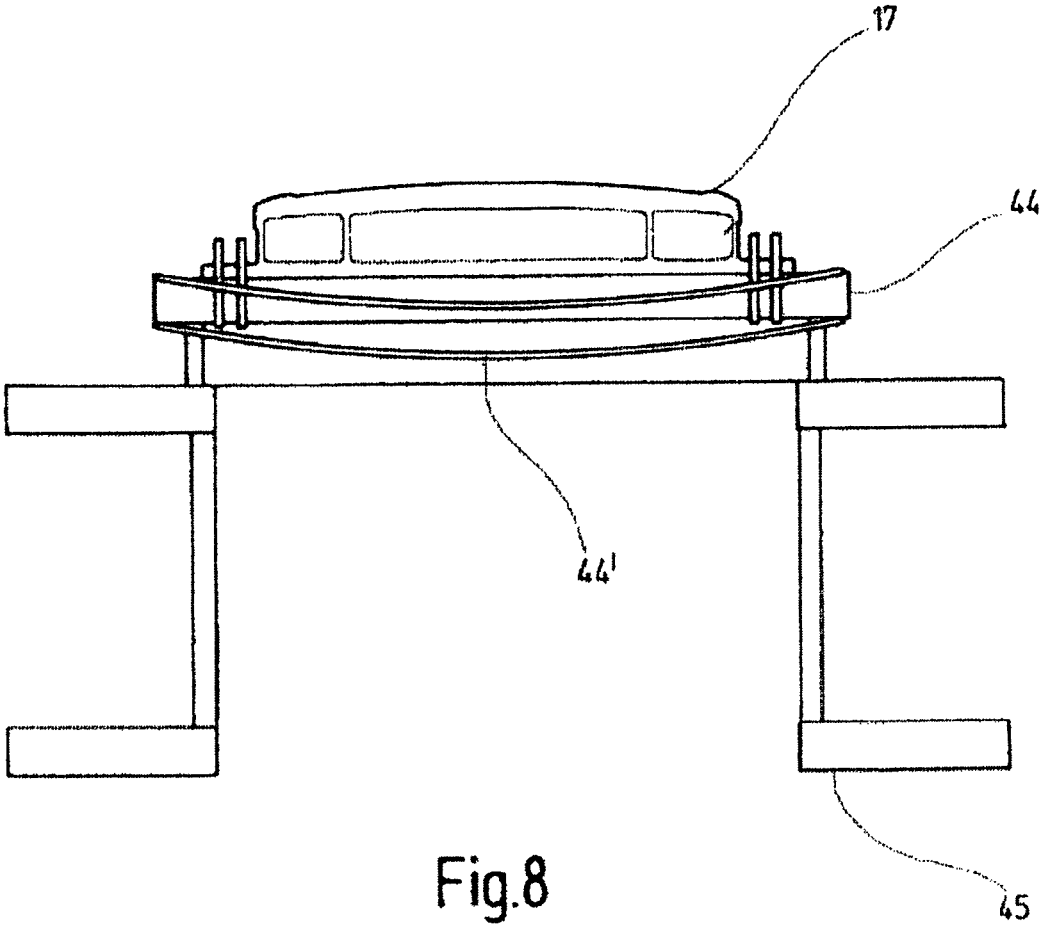
FIG. 8 shows a lower tool part on a press table with low rigidity and a large deflection.

FIG. 8 shows in this connection, while omitting unimportant details and using the same reference numerals, the bending of the slide table 44 in an exaggerated representation. The bending of the slide table 44 is indicated by full lines, which symbolize the bent table 44'. The bending is in the flexible range. Also the tool piece 17 is subjected to a corresponding bending which however is not shown.

Figure 10:
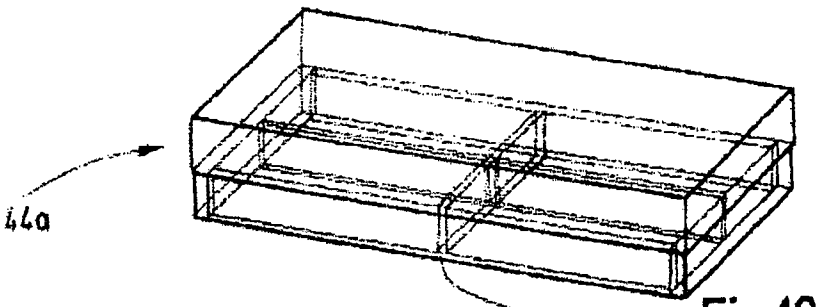
FIG. 10 shows schematically in principle a different press table in a perspective view.
Figure 11:
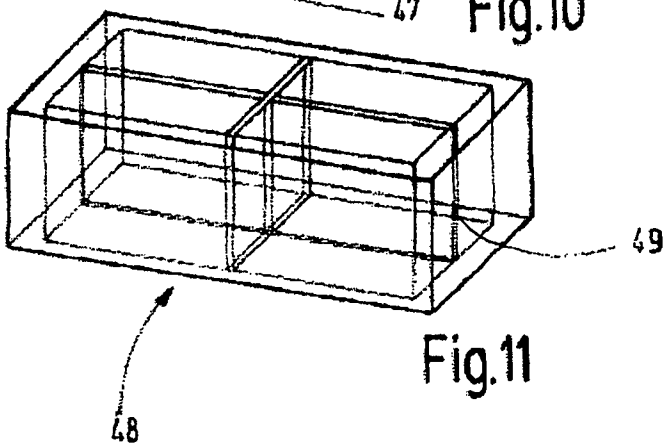
FIG. 11 shows schematically a press table stiffening element in a perspective view.
Figure 9:
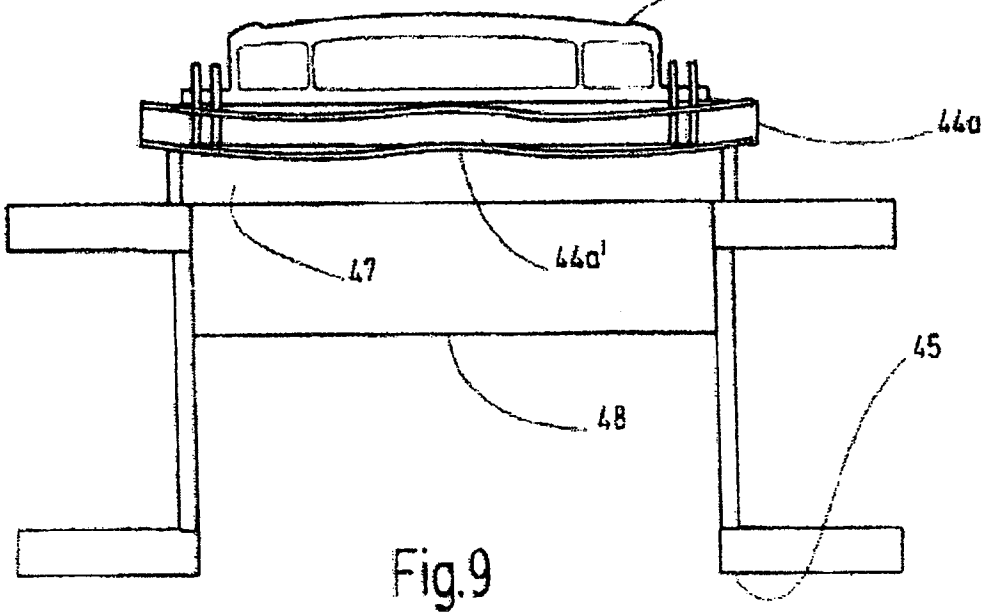
FIG. 9 shows the tool of FIG. 8 with high rigidity and little deflection.

FIG. 9 shows the conditions with respect to the bending of the same tool part 17 on a more rigid slide table 44*a*. As also apparent from FIG. 10, this table is provided with a stiffening structure 47 which is formed, for example, by beam-ribs, support structures or similar components. Below the stiffening structure 47, a reinforcement element 48 (FIG. 11) is arranged by which the press table is further stiffened. It may comprise ribs 49 or similar support elements and all together have the shape of a box and may be connected at its top side with the stiffening structure 47 or, respectively, the slide table 44*a*. The press table formed and stiffened in this way is relatively rigid. It is subject to substantially less bending than the press table of FIG. 8. The bending of the press table 44*a*' is shown in FIG. 9 symbolically by solid lines.

Figure 12:
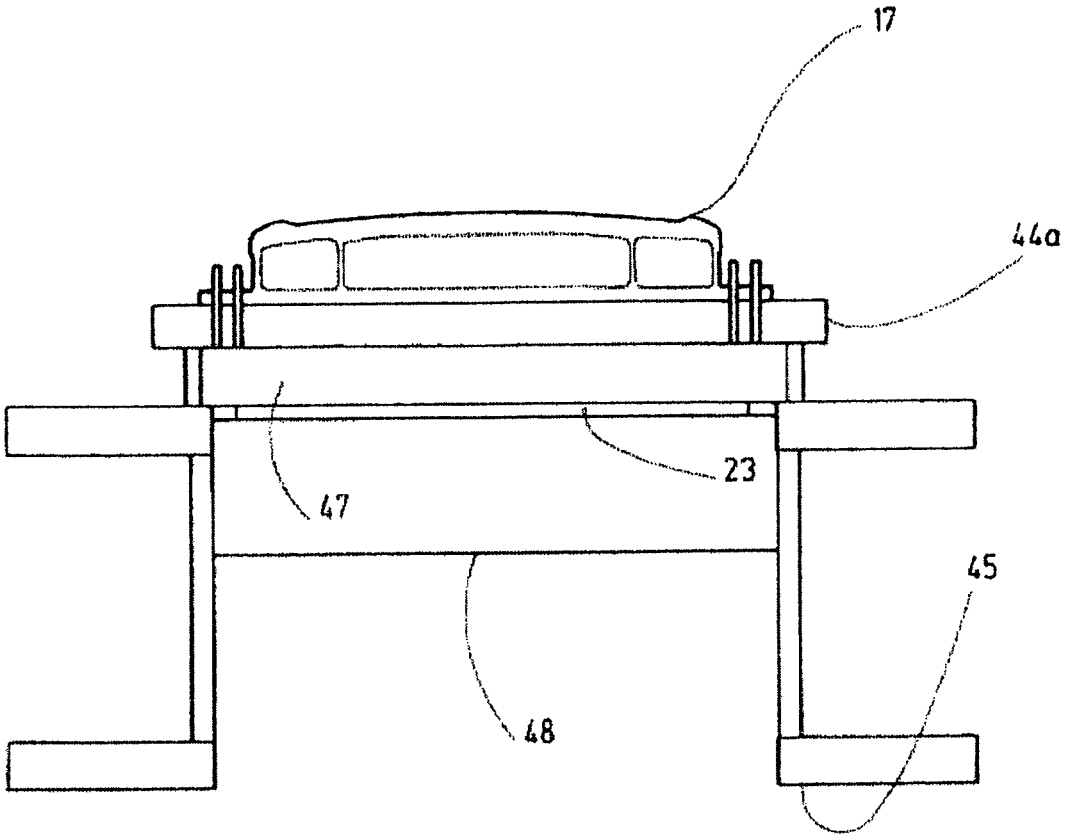
FIG. 12 shows the tool as shown in FIGS. 7 and 8 mounted on a press table together with additional elements for influencing the rigidity.

FIG. 12 shows the arrangement according to FIG. 9 wherein between the press table 44*a* or, respectively, its stiffening structure 47 and the reinforcement element 48 the additional component 23 in this form of a plate is arranged.

Figure 14:
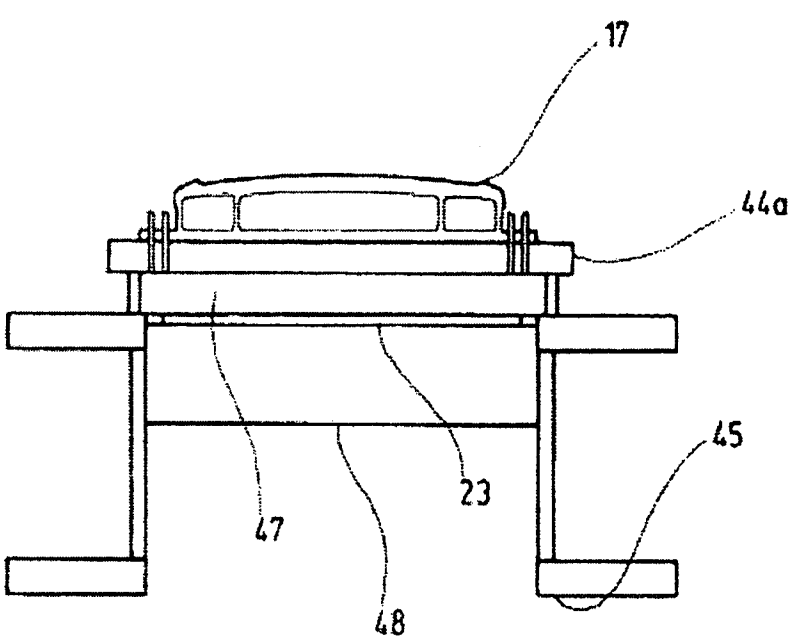
Figure 13:
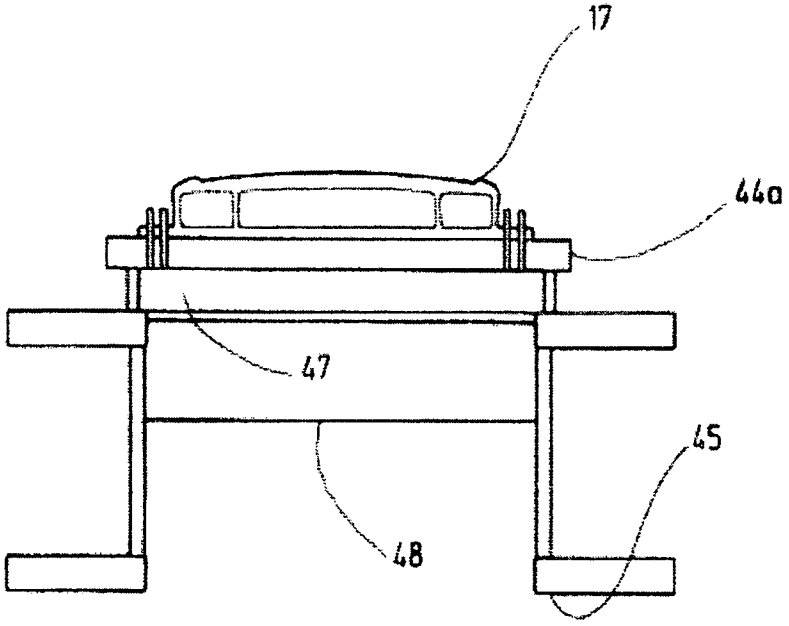
FIG. 13 shows the mounting of the tool on a rigid press table with little coupling; and, FIG. 14 shows the set up of the tool on a rigid press table with high coupling.

As a comparison between the FIGS. 13 and 14 shows the additional part 23 may be provided or it may be omitted whereby the stiffness of the stiffening element 48 is selectively coupled into the tool part 17 or not. In this way, the tools, which are provided for presses of relatively low rigidity, may also be used in connection with press tables which are very stiff because they have a high intrinsic rigidity by the reinforcement element 48. As shown in FIG. 13, in this case the slide table 44*a* is supported only at its outer rim, while it forms in its center area a horizontal slot with the reinforcement element 48. The effective stiffness of the tool parts 17 is obtained herein by a "switching" of the rigidity of the slide table 44*a* in that it is either coupled by means of the intermediate plate 23 to the reinforcement element 48 (FIG. 14) or the coupling is omitted by not installing the intermediate plate 23 (FIG. 13).

Accordingly, a tool for a press is established which comprises at least a tool part whose stiffness is adjustable. The stiffness is adjusted by the coupling of the tool part to the plunger 6 and/or the press table 7 taking into consideration the transmission of deformations by bending. Considering the tool part and the press part (plunger or table) as bending springs, the means for adjusting the stiffness of the tool part resides in a means for changing the coupling between the two bending springs.

What is claimed is:

1. A press (1) including first components (16, 17) consisting of an upper tool part (16) and a lower tool part (17), a press table (6) in supportive relationship with the lower tool part (17), a plunger (7) in supportive relationship with the upper tool part (16), means for adjusting during set-up of the press (1) the effective overall rigidity of the upper tool part (16) and the plunger (7) and/or the lower tool part (17) and press table (6) between at least two selectable rigidity values, the means for adjusting during set-up of the press (1) the effective overall rigidity of the upper tool part (16) and the plunger (7) and/or the lower tool part (17) and the press table (6) between at least two selectable rigidity values includes the press table (6) includes a slidable table (44) and at least one of a stiffening structure (47) for contact with the slidable table (44) for increasing the effective rigidity of the slidable table (44) and a reinforcing element (48) for increasing further the effective rigidity of the slidable table (44) and an additional component (23) removably positioned between the at least one stiffening structure (47) and the reinforcing element (48) for providing an adjustable rigidity of the reinforcing element (48).

2. A press (1) including first components (16, 17) consisting of an upper tool part (16) and a lower tool part (17), a press table (6) in supportive relationship with the lower tool part (17), a plunger (7) in supportive relationship with the upper tool part (16), means for adjusting during set-up of the press (1) the effective overall rigidity of the upper tool part (16) and the plunger (7) and/or the lower tool part (17) and press table (6) between at least two selectable rigidity values, the means for adjusting during set-up of the press (1) the effective overall rigidity of the upper tool part (16) and the plunger (7) and/or the lower tool part (17) and press table (6) between at least two selectable rigidity values includes at least one additional component (23) including one of a first intermediate plate (24) or a second intermediate plate (27), at least one of the upper tool part (16) having a first recess (18) on the upper surface thereof and/or the lower tool part (17) having a second recess (19) on the lower surface thereof, the at least one additional component (23) is removably disposed in the second recess (19) and in operative contact between the lower tool part (17) and the press table (6) and/or the at least one additional component (23) is removably disposed in the first recess (18) and in operative contact between the upper tool part (16) and the plunger (7).

3. The press (1) according to claim 2, wherein the first recess (18) or the second recess (19) is a slot.

4. The press (1) according to claim 3, wherein the slot first recess (19) of the lower tool part (17) is arranged so as to extend parallel to a support surface (20, 21) of the lower tool part (17).

5. The press (1) according to claim 3, wherein the slot first recess (19) of the lower tool part (17) is disposed adjacent a surface (14) of the press table (6).

6. The press (1) according to claim 2, wherein the additional component (23) has at least one dimension corresponding to the first recess (18) or the second recess (19).

7. The press (1) according to claim 2, wherein the additional component (23) fills the first recess (18) or the second recess (19) at least partially.

8. The press (1) according to claim 2, wherein the first intermediate plate (24) is a flat plate.

9. The press (1) according to claim 2, wherein the second intermediate plate (27) has a side having a plurality of third recesses (28, 29, 30).

* * * * *